US007051839B1

(12) United States Patent
George

(10) Patent No.: US 7,051,839 B1
(45) Date of Patent: May 30, 2006

(54) CAMOUFLAGE DEVICE FOR EQUIPMENT LEGS

(76) Inventor: Randall D. George, 9251 Hartley Rd., Hallsville, MO (US) 65255

( * ) Notice: Subject to any disclaimer, the term of this patent is extended or adjusted under 35 U.S.C. 154(b) by 32 days.

(21) Appl. No.: 10/813,718

(22) Filed: Mar. 31, 2004

(51) Int. Cl.
*B32B 1/08* (2006.01)

(52) U.S. Cl. ..... 182/116; 182/115; 182/194; 428/17; 428/27; 428/36.9; 428/919; 43/1

(58) Field of Classification Search ..... 428/17, 428/27, 99, 919, 36.9; 47/41.12, 41.13; 43/1; 182/115, 116, 194
See application file for complete search history.

(56) References Cited

U.S. PATENT DOCUMENTS

| | | | | |
|---|---|---|---|---|
| 3,170,587 | A | 2/1965 | Beeber | 220/23.87 |
| 3,193,852 | A | 7/1965 | Murrmann | 114/351 |
| 3,928,712 | A | 12/1975 | Sears | 174/38 |
| 4,792,471 | A | 12/1988 | Lee | 428/17 |
| 4,813,441 | A | 3/1989 | Kepley | 135/90 |
| 5,037,052 | A | 8/1991 | Crisp et al. | 248/229 |
| 5,080,193 | A | 1/1992 | Woof | 182/116 |
| 5,130,496 | A | 7/1992 | Jenkins | 174/135 |
| 5,733,612 | A * | 3/1998 | Garry | 428/23 |
| 5,895,288 | A | 4/1999 | Nelson | 439/502 |
| 6,004,635 | A * | 12/1999 | Li | 428/23 |
| 6,306,471 | B1 | 10/2001 | Pitman et al. | 428/18 |
| 6,343,440 | B1 | 2/2002 | Ayers | 52/40 |
| 6,543,175 | B1 | 4/2003 | Tucker | 42/94 |
| 2001/0013212 | A1 | 8/2001 | Sanchez et al. | 52/736.1 |
| 2003/0074825 | A1 | 4/2003 | Beaty | 43/1 |
| 2003/0124270 | A1 | 7/2003 | Porter | 428/17 |

* cited by examiner

*Primary Examiner*—Alexander S. Thomas
(74) *Attorney, Agent, or Firm*—Grace J. Fishel

(57) ABSTRACT

A device for providing three dimensional camouflage to a hunter's ladder stand having a seat, footrest, side rails and a plurality of rungs. The device has a hollow plastic tube with a split and holes through which a plurality of stalks of artificial vegetation are inserted. The split is in the form a groove or has notches so that when the tube is attached to a rail of a ladder stand, the tube does not interfere with the rungs.

10 Claims, 3 Drawing Sheets

CAMOUFLAGE DEVICE FOR EQUIPMENT LEGS

BACKGROUND OF THE INVENTION

1. Field of the Invention

The present invention relates to a camouflage device for use on a hunter's ladder stand, tripod stand, tripod feeder and the like having long legs.

2. Brief Description of the Prior Art

A hunter's ladder-stand, tripod stand, tripod feeder, and the like are easily detectable by wild life against a natural background even in dim lighting. Painting the framework with a neutral color or using a random, irregular color treatment in muted browns, greens, and the like has a positive effect in camouflaging the framework. However, since the paint is in effect, two dimensional, it does nothing to break up the outline of the stand or rack.

Three dimensional camouflage, as opposed to two dimensional camouflage, is a more powerful form of concealment. In the past, hunters, photographers and other nature observers have used bundles or sprigs of natural vegetation as camouflage. This works for smaller equipment such as a tree stand (e.g., U.S. Pat. No. 4,813,441) or a screen behind which the hunter can crouch (e.g., U.S. Pat. No. 6,543,175). The live vegetation scatters the light creating natural shadows and depth and may also move with the wind in a natural manner.

While bundles or sprigs of vegetation may be tied to a tree stand, this form of camouflage is impractical for the long legs of a ladder stand, tripod stand or the like. In addition, gathering live foliage may be prohibited by the private owners or governmental custodians of the land. Even if permitted, the act of gathering the foliage may scare away the wild life and, if the framework is left in place, the foliage may dry out and need to be replaced.

BRIEF SUMMARY OF THE INVENTION

In view of the above, it is an object of the present invention to provide a camouflage device for use on the framework of a ladder stand or the like. It is another object to provide a camouflage device that can be attached to the framework before it is taken into the field such that setup of the camouflaged equipment is quick and easy. It is also an object to provide a camouflage device that makes use of artificial foliage that is not particularly subject to deterioration. Other objects and features of the invention will be in part apparent and in part pointed out hereinafter.

In accordance with the invention, a camouflage device for use with a hunter's ladder stand having a seat, footrest, side rails and a plurality of rungs has a hollow plastic tube with a sidewall having a longitudinal split, a diameter such that the tube can be disposed around the side rails and a plurality of spaced apart holes extending along the tube and covering an area opposite the split and about half the circumference of the tube, and a plurality of stalks of artificial vegetation, each stalk inserted into one of the holes, said stalks occupying a portion or all of the holes for camouflaging the side rails. The split may be in the form of a groove or a slit with notches so that when the device is attached to a side rail of the ladder stand, the device does not interfere with the rungs.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which two of various possible embodiments of the invention are illustrated, corresponding reference characters refer to corresponding parts throughout the several views of the drawings in which.

DETAILED DESCRIPTION OF THE INVENTION

Figure 1:
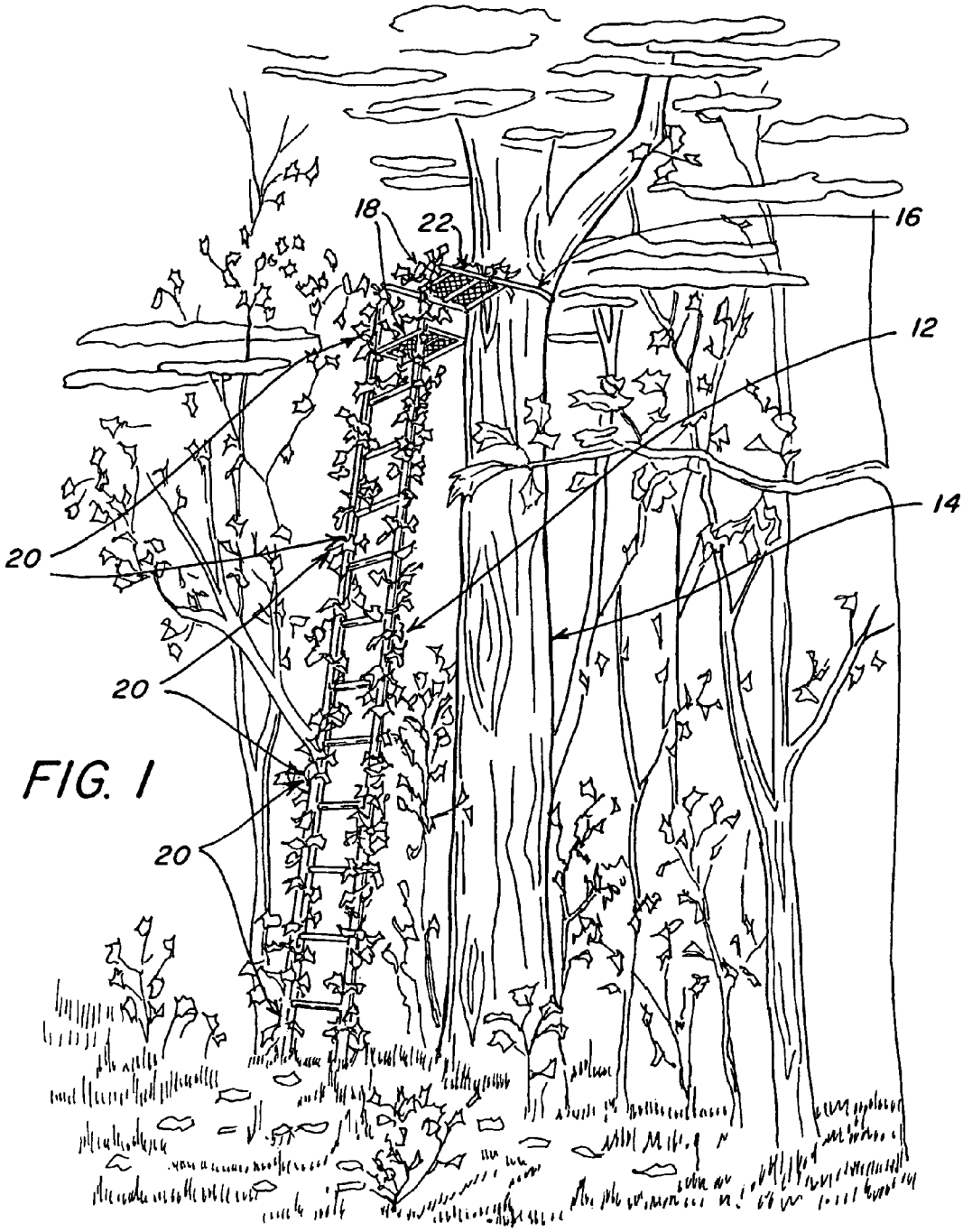
FIG. 1 is a perspective view of a camouflage device in accordance with the present invention installed on a hunter's ladder stand shown in use at a hunting site.

Referring to the drawings more particularly by reference character, reference numeral 10 refers to a camouflage device in accordance with the present invention. In FIG. 1, device 10 is shown in use camouflaging a hunter's ladder stand 12. Ladder stand 12 is shown attached to a tree 14 with a strap 16. A stabilizer bar (not shown) attached with a second strap may be provided for additional lateral stability.

Ladder stand 12 is preferably formed in sections including a platform section 18 and two or more ladder sections 20. Platform section 18 includes a seat 22 and a footrest 24. Ladder sections 20 include side rails 26 and rungs 28. Typically, ladder sections 20 are about four feet in length and rungs 28 are about 10 inches apart. A twelve-foot or sixteen-foot ladder stand 12 puts platform section 18 at a height where a user does not have to worry about being detected by wary, hunter-wise game. Ladder stand 12 shown in FIG. 1 has three ladder sections 20.

Side rails 26 may be formed of one inch square tubing and rungs 28 of one-half inch square tubing. Rungs 28 are welded to rails 26 or otherwise attached. It will be understood, however, that the present invention is not limited to these particulars as device 10 may be used with all kinds of ladder stands and hunter equipment in general such as tripod stands, tripod feeders and the like having long legs forming a silhouette that may spook game.

Figure 2:
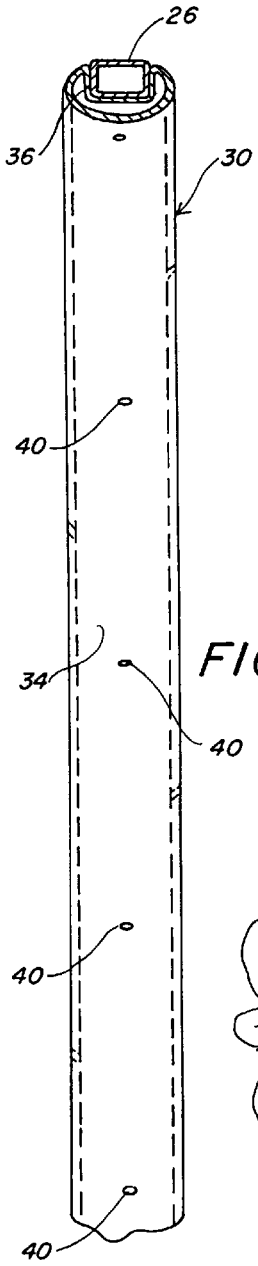
FIG. 2 is a perspective view a tube portion of the camouflage device.
Figure 4:
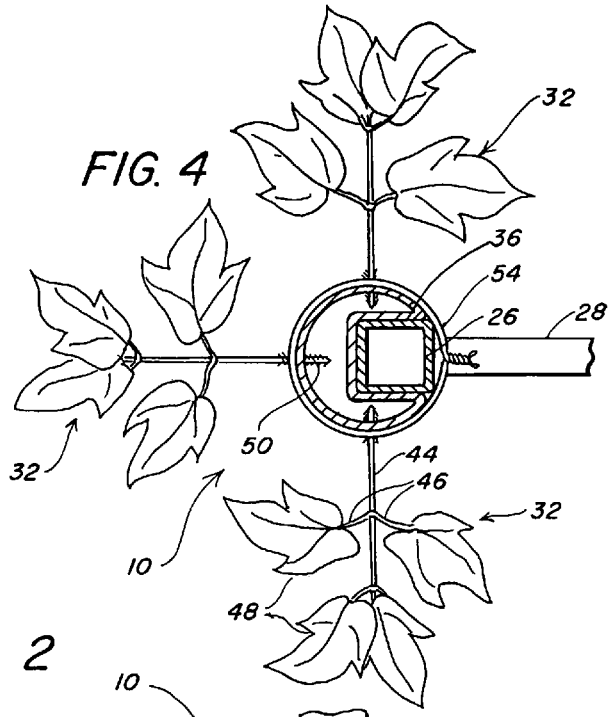
FIG. 4 is a section taken along the plane of 4—4 in FIG. 3.
Figure 6:
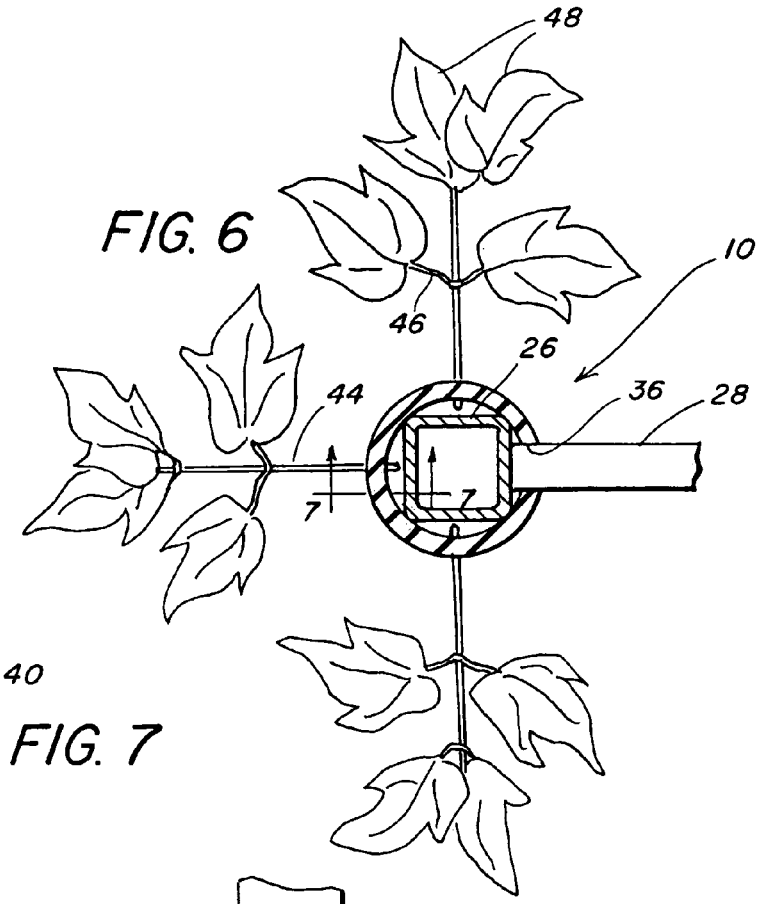
FIG. 6 is a section taken along the plane 6—6 in FIG. 5.
Figure 5:
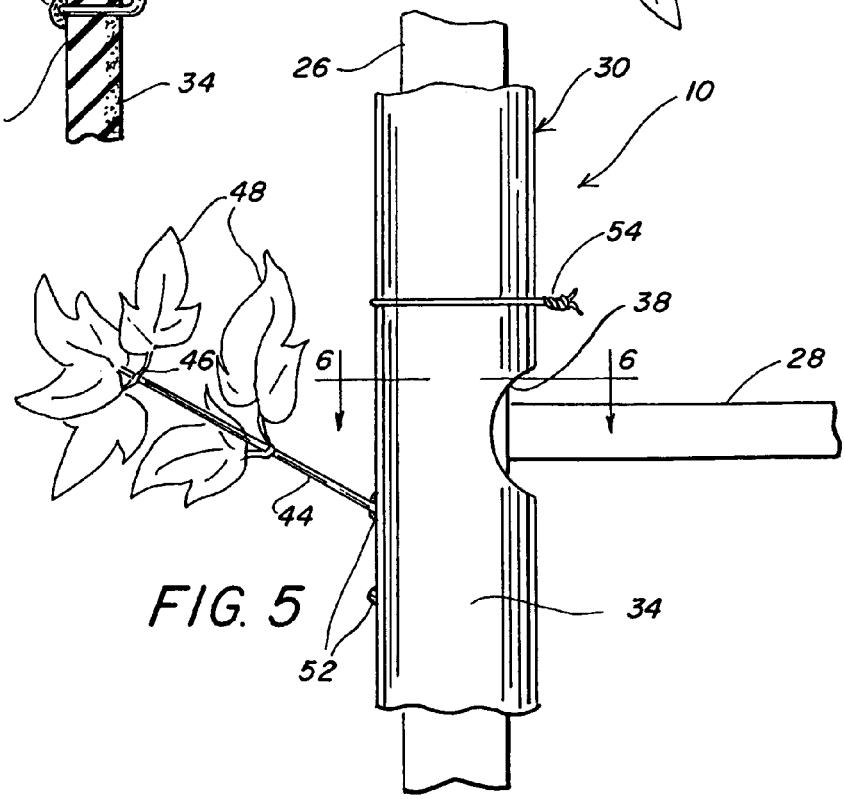
FIG. 5 is a side elevation of a second embodiment of the camouflage device shown attached to a side rail of the ladder stand.

Device 10 is formed from a hollow plastic tube 30 and a plurality of stalks 32 of artificial vegetation as more particularly described hereinafter. Tube 30 may be formed of a recycled plastic. Tube 30 is preferably either two or four feet long or otherwise sized to the length or to divisions of the length of ladder sections 20. As shown in FIGS. 2 and 4, tube 30 has a sidewall 34 with a longitudinal split 36 in the form of a groove running the length of tube 30. Tube 30 has a diameter such that it can be disposed around side rails 26 of ladder sections 20. As shown in FIGS. 2 and 4, sidewall 34 may have a thickness of about ⅛ inch and groove 36 is configured for receipt of one of side rails 26. Alternatively, as shown in FIG. 6, tube 30 may have a diameter of about two inches, a sidewall thickness of about ⅜ inch and be formed of a foamed plastic material with split 36 formed as a slit in sidewall 34 instead of a groove. As shown in FIG. 5, tube 30 may be provided with spaced apart notches 38 in split 36 for clearance around rungs 28.

Tube 30 may be covered on an outer surface with a coating providing an appearance of artificial bark. In order to achieve an even more realistic appearance, knots and other surface textures may be added.

Figure 3:
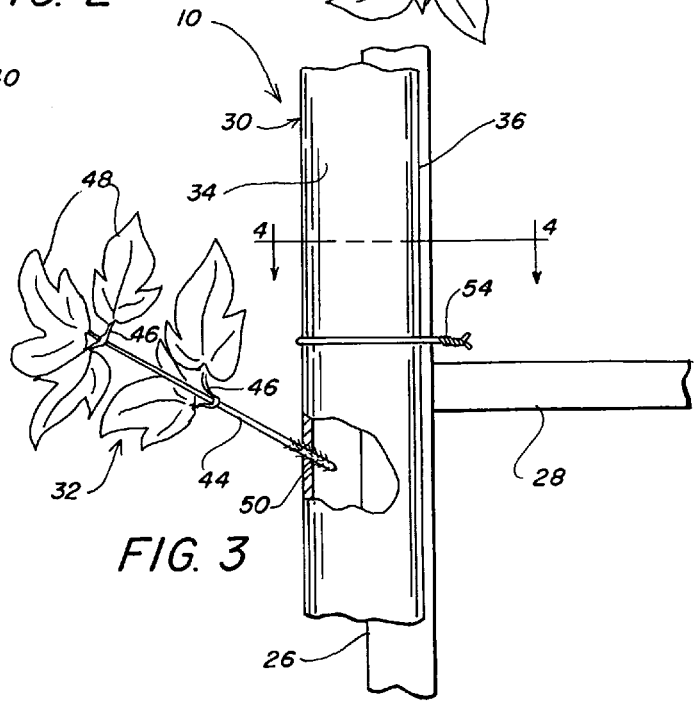
FIG. 3 is a side elevation of the device shown attached to a side rail of the ladder stand and partially broken away to show a barbed main stem of a stalk of artificial vegetation inserted into a hole in the tube.
Figure 7:
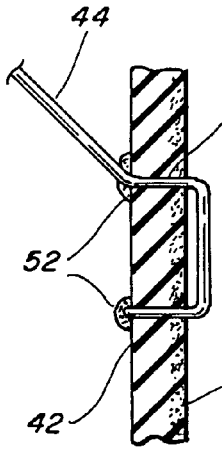
FIG. 7 is a section taken along the plane 7—7 in FIG. 6.

A plurality of spaced apart holes 40 are formed in sidewall 34 covering an area opposite split 36 and about half the circumference of tube 30. Holes 40 extend along tube 30 and are formed in three or more parallel rows. Holes 40 are spaced apart about four to eight inches in each row and holes 40 in adjacent rows are staggered. The spacing between the holes in each row may be regular or irregular. When tube 30 is as shown in FIGS. 2–4, holes 40 may be angled upwardly towards an end of tube 30. When tube 30 is as shown in FIGS. 5–7, a return hole 42 is provided adjacent each entry hole 40.

Stalks 32 of artificial vegetation include a main stem 44 and may include secondary stems 46 connected to leaves 48. Stalks 32 may be different lengths. Stalks 32 measuring six to ten inches have been found satisfactory, although other lengths are possible and may even be preferred. Different types of leaves 48 may be provided which correspond to the species and seasonal coloration of live foliage at the selected deployment site. In some cases, stalks 32 may bear no leaves for use in winter hunting or may be formed with darker stems for a mesquite look. Stalks 32 of artificial vegetation are preferably formed of a durable material which is not readily subject to deterioration when exposed to the elements over a hunting season and include so-called silks.

Holes 40 (and return hole 42) are sized for receipt of main stem 44 of stalks 32. When main stem 44 is formed of plastic, it may be barbed 50 as shown in FIGS. 3 and 4 such that when inserted in one of holes 40, the barbs drag against the sidewall surround the hole to prevent removal of the stem. By tugging hard, however, barbs 50 slip through holes 40 and stalks 32 can be removed and other stalks 32 inserted to update device 10 to the season and hunting site. When main stem 44 is formed of wire and is not barbed, stem 44 may be threaded into hole 40 and out of return hole 42 as shown in FIGS. 5–7. A drop of glue 52 may be applied to stem 44 at hole 40 and return hole 42. When a coating is applied to the outside of tube 30 as discussed above, drop of glue 52 looks like a knot or leaf scar. All of holes 40 may be filled with stalks 32 or only selected ones of holes may be filled. Main stem 44, secondary stems 46 and leaves 48 may be twisted to give stalk 32 a more natural appearance.

In use, after device 10 has been assembled as described above, it may be attached to rail 26 with an attachment means 54 as shown in FIGS. 3 and 5. Suitable attachment means 54 include bands with hook and pile fasteners such as sold under the registered trademark VELCRO, plastic ties, wire ties and the like. Device 10 may be attached to rail 26 with attachment means 54 at opposite ends of tube 30. An additional attachment means 54 may be applied at the middle of tube 30.

While device 10 may be assembled and installed on ladder stand 12 in the field, it may be easier if device 10 is attached to ladder sections 20 and platform section 18 before reaching the hunting site. This makes setup of the camouflaged equipment quick and easy. While illustrated with ladder stand 12 and designed for use thereon, device 10 can be used to break up the silhouette of other long-legged hunting equipment such as a hunter's tripod stand, tripod feeder and the like. Lengths of tube 30 may also be used to camouflage a rack of a four wheeler and the like.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A camouflage device comprising a hunter's ladder stand having a seat, footrest, side rails and a plurality of rungs, a hollow plastic tube with a sidewall having a longitudinal split, a diameter such that the tube is disposed around the side rails and a plurality of spaced apart holes extending along the tube and covering an area opposite the split and about half the circumference of the tube, a plurality of stalks of artificial vegetation, each stalk inserted into one of the holes, said stalks occupying a portion or all of the holes for camouflaging the side rails.

2. The device of claim 1 wherein the holes are angled upwardly towards an upper end of the tube.

3. The device of claim 1 wherein the stalks have barbed ends for frictional engagement with the holes.

4. A camouflage device comprising a hunter's ladder stand having a platform section with a seat and a footrest and two more ladder sections, each section having side rails and a plurality of rungs, a hollow plastic tube having an upper and a lower end, said tube having a sidewall with a length substantially equal to the ladder sections, said sidewall having a longitudinal split, a diameter such that the tube is disposed around the side rails of the section and a plurality of spaced apart holes extending substantially the length of the tube and covering an area opposite the split and about half the circumference of the tube, said holes angled upwardly towards the upper end of the tube, a plurality of stalks of artificial vegetation, each stalk inserted into one of the holes, said stalks occupying a portion or all of the holes and angled upwardly for camouflaging the side rails of the section.

5. The device of claim 4 further comprising a band for attaching the upper and lower ends of the tube to the section.

6. The device of claim 4 wherein the stalks have barbed ends for frictional engagement with the holes.

7. A camouflage device for use with a hunter's ladder stand having a platform section with a seat and a footrest and two more ladder sections, each section having side rails and a plurality of rungs formed of square tubing, said device comprising a hollow plastic tube having an upper and a lower end, said tube having a sidewall with a length substantially equal to the length of the ladder sections, said sidewall having a longitudinal groove configured for receipt of one of the side rails of the ladder sections and a plurality of spaced apart holes extending substantially the length of the tube and covering an area opposite the groove and about half the circumference of the tube, said holes angled upwardly towards the upper end of the tube, a plurality of stalks of artificial vegetation, each stalk inserted into one of the holes, said stalks occupying a portion or all of the holes and angled upwardly for camouflaging the side rails of the section.

8. The device of claim 7 further comprising a band for attaching the upper and lower ends of the tube to the section.

9. The device of claim 7 wherein the stalks have barbed ends for frictional engagement with the holes.

10. A camouflage device for use with a rack on a four wheeler, hunter's ladder stand or hunter's tripod stand having rails, said device comprising a hollow plastic tube having an upper and a lower end, said tube having a sidewall with a length substantially equal to a length of the rails or to a length of a section of the rails, said sidewall having a longitudinal groove configured for receipt of one of the rails and a plurality of spaced apart holes extending substantially the length of the tube and covering an area opposite the groove and about half the circumference of the tube, said holes angled upwardly towards the upper end of the tube, a plurality of stalks of artificial vegetation, each stalk inserted into one of the holes, said stalks occupying a portion or all of the holes and angled upwardly for camouflaging the rails, and, attachment means for securing the upper and lower end of the tube to one of the rails or rail sections.

* * * * *